US009039457B2

(12) United States Patent
Zhang

(10) Patent No.: US 9,039,457 B2
(45) Date of Patent: May 26, 2015

(54) CONNECTING SYSTEM WITH LOCKING STRUCTURE

(71) Applicant: Molex Incorporated, Lisle, IL (US)

(72) Inventor: Xue-Hai Zhang, Kunshan (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 14/098,196

(22) Filed: Dec. 5, 2013

(65) Prior Publication Data

US 2014/0179145 A1 Jun. 26, 2014

(30) Foreign Application Priority Data

Dec. 10, 2012 (CN) ..... 2012 2 0678711 U

(51) Int. Cl.

| | |
|---|---|
| ***H01R 24/00*** | (2011.01) |
| ***H01R 13/627*** | (2006.01) |
| *H01R 13/6582* | (2011.01) |
| *H01R 24/60* | (2011.01) |

(52) U.S. Cl.

CPC ..... *H01R 13/6275* (2013.01); *H01R 13/6582* (2013.01); *H01R 24/60* (2013.01)

(58) Field of Classification Search

USPC ..... 439/357, 660

See application file for complete search history.

(56) References Cited

U.S. PATENT DOCUMENTS

| | | | | |
|---|---|---|---|---|
| 8,038,480 | B2 | 10/2011 | Wei | |
| 2010/0136830 | A1 * | 6/2010 | Chen et al. | 439/607.01 |
| 2010/0226612 | A1 * | 9/2010 | Sedio et al. | 385/93 |
| 2013/0040501 | A1 | 2/2013 | Peng | |

FOREIGN PATENT DOCUMENTS

| | | | |
|---|---|---|---|
| CN | 2924840 | Y | 7/2007 |
| CN | 201315359 | Y | 9/2009 |
| CN | 201387960 | Y | 1/2010 |

* cited by examiner

*Primary Examiner* — Briggitte R Hammond
(74) *Attorney, Agent, or Firm* — Stephen L. Sheldon

(57) ABSTRACT

A receptacle connector and a plug connector are disclosed. The receptacle comprises a housing, a plurality of first terminals and a cage; a front end of the housing is formed with a mating cavity and a receiving cavity positioned above and communicated to the mating cavity, the first housing is further penetratingly opened with a receiving groove above the receiving cavity; the cage is provided with a locking portion protruding downwardly into the receiving groove. The plug connector comprises a housing, a plurality of terminals, a cage and a hook, the cage comprises a main body portion and a protruding portion positioned above the main body portion and having a smaller width; the hook protrudes upwardly out from the protruding portion of the second cage. The locking portion of the receptacle can correspondingly engage the hook of the plug.

5 Claims, 17 Drawing Sheets

CONNECTING SYSTEM WITH LOCKING STRUCTURE

RELATED APPLICATIONS

This application claims priority to Chinese Application No. 201220678711.0, filed Dec. 10, 2012, which is incorporated herein by reference in its entirety.

TECHNICAL FIELD

The present application relates to an electrical connector, and particularly relates to an receptacle connector and an plug connector which are not easily disengaged accidentally.

BACKGROUND ART

Chinese patent application CN200920001857.X discloses an electrical connector, which comprises: a housing formed of an insulative material, a rear part of which is formed with an accommodating cavity, and a front part of which protrudes forwardly to form a tongue; a plurality of terminals which comprise an upper row of terminals and a lower row of terminals respectively mounted to an upper side and a lower side of the tongue, the each terminal has a mating portion, a tail, and a curved portion connected between the mating portion and the tail, the mating portions of the upper row of terminals and the mating portions of the lower row of terminals are mounted to the upper side and the lower side of the tongue, respectively, the tails of the each row of terminals extend out from a lower side of the rear part of the housing and are arranged as two rows (i.e. a front row and a rear row); an outer cage which is mounted to an outer periphery of the housing; and two positioning modules which mounted in the accommodating cavity of the housing and cover outer peripheries of the curved portions of the plurality of terminals, which can effectively prevent the curved portions of the terminals from being bent and contacting with each other to cause a short circuit failure when subjected to an external force. When this electrical connector in the prior art is mated with another mating electrical connector, an engagement is maintained by that a plurality of leaf springs extending inwardly from the outer cage of this electrical connector latch on an outer cage of the mating electrical connector. An engagement force between these two electrical connectors is limited, accidental disengagement easily occurs in an environment that experiences significant noise, vibration and harshness (such as an automobile or in moving machinery). Therefore, it is necessary to improve the engagement structure of the electrical connector in the prior art.

SUMMARY OF THE INVENTION

A receptacle connector has a housing from which a tongue extends forwardly. A plurality of terminals are supported by the housing and each have a mating portion and a tail, the mating portions of the plurality of terminals being respectively provided at an upper side and a lower side of the tongue, the plurality of terminals comprising two current terminals and a plurality of differential signal terminals, the mating portions of the two current terminals being provided on opposing sides of the tongue. A width of the mating portions of the two current terminals is greater than a width of the mating portions of these differential signal terminals. A cage is mounted to an outer periphery of the housing and a front end of the housing is formed with a mating cavity provided around the tongue and a receiving cavity positioned above and communicated to the mating cavity. A width of the receiving cavity is smaller than a width of the mating cavity and the housing is further includes a receiving groove above the receiving cavity and the cage is provided with a locking portion for engaging a hook of a mating plug connector, the locking portion protrudes downwardly into the receiving groove of the first housing.

The cage comprises a front plate provided at a front end of the receptacle connector, a top end of the front plate is bent rearwardly to form a fold edge and then a center of a front edge of the fold edge is firstly bent downwardly and then bent rearwardly and extends to form the locking portion. The cage comprises a front plate provided at a front end of the receptacle connector and a leaf spring latch piece, the front plate extends toward inside of the first mating cavity to form a plurality of first resilient arms, the leaf spring latch piece comprises a latching portion latching on the first housing and a second resilient arm extending into the first mating cavity. The housing comprises a first main body and a second main body stacked up-down together, and a first outer housing installed to outer peripheries of the first main body and the second main body and the plurality of terminals are embedded into the first main body and the second main body respectively.

In an embodiment, the tongue extends forwardly out from the first main body, the upper side and the lower side of the tongue are provided with a plurality of terminal grooves, the mating portion of the first terminal embedded into the second main body are correspondingly received in the terminal grooves at the lower side of the tongue; the first mating cavity and the receiving cavity are recessed at a front end of the first outer housing, the receiving groove is opened at a top of the first outer housing.

A plug connector includes a housing which extends forwardly to form an upper mating board and a lower mating board. A plurality of terminals, each of the plurality of terminals having a mating portion and a tail, the mating portions of these second terminals being respectively provided at a lower side surface and an upper side surface of the lower mating board, the plurality of terminals include two current terminals and a plurality of differential signal terminals, the mating portions of the two current terminals being provided on opposing sides of upper mating board and the lower mating board. The mating portions of the current terminals have a width is greater than a width of the mating portions of the differential signal terminals. A cage is mounted to an outer periphery of the housing and comprises a main body portion and a protruding portion positioned above the main body portion and having a smaller width; the main body portion of the cage and the upper mating board and lower mating board of the second housing are enclosed to form a mating cavity, the protruding portion of the cage and the upper mating board of the second housing are enclosed to form a latching cavity. The plug connector further comprises a hook, the hook comprises a fixed portion positioned at a rear end thereof and a hook portion positioned at a front end thereof, the hook portion is capable of moving up and down in the latching cavity and protrudes upwardly from the protruding portion of the second cage.

The plug connector can further comprise a pressing portion which has an inverted U-shaped configuration and is positioned between the fixed portion and the hook portion. The second housing can protruded upwardly with a guide frame protruding at both sides thereof and recessed at a center thereof, a front part of the hook is suspended above the guide frame. An embodiment can include a second outer housing provided to an outer periphery of the second cage, the second outer housing is provided with a button thereon for correspondingly pressing the pressing portion of the hook. The plug connector can further include a second outer housing provided to an outer periphery of the second cage, the fixed portion of the hook is provided with a mounting hole, the hook can be fixed to the second outer housing via a fastener provided through the mounting hole.

DETAILED DESCRIPTION OF THE PREFERRED EMBODIMENTS

Hereinafter the present disclosure will be further described in details in combination with the Figures. The technical problems to be solved by the present disclosure are believe to help overcome the above noted deficiencies in the prior art, and are directed toward providing an receptacle connector and an plug connector that have a strong engagement force so as to avoid unexpected disengagement. Compared with the prior art, in the receptacle connector and the plug connector of the present disclosure, by that the first cage of the receptacle connector is additionally provided with the receiving cavity and the hook portion positioned above the receiving cavity, and the plug connector is correspondingly provided with the protruding portion and the hook protruding upwardly from the protruding portion, the receptacle connector and the plug connector of the present disclosure are correspondingly latched and locked together, thereby having a strong engagement force to prevent the two electrical connectors from being accidentally disengaged.

Figure 1:
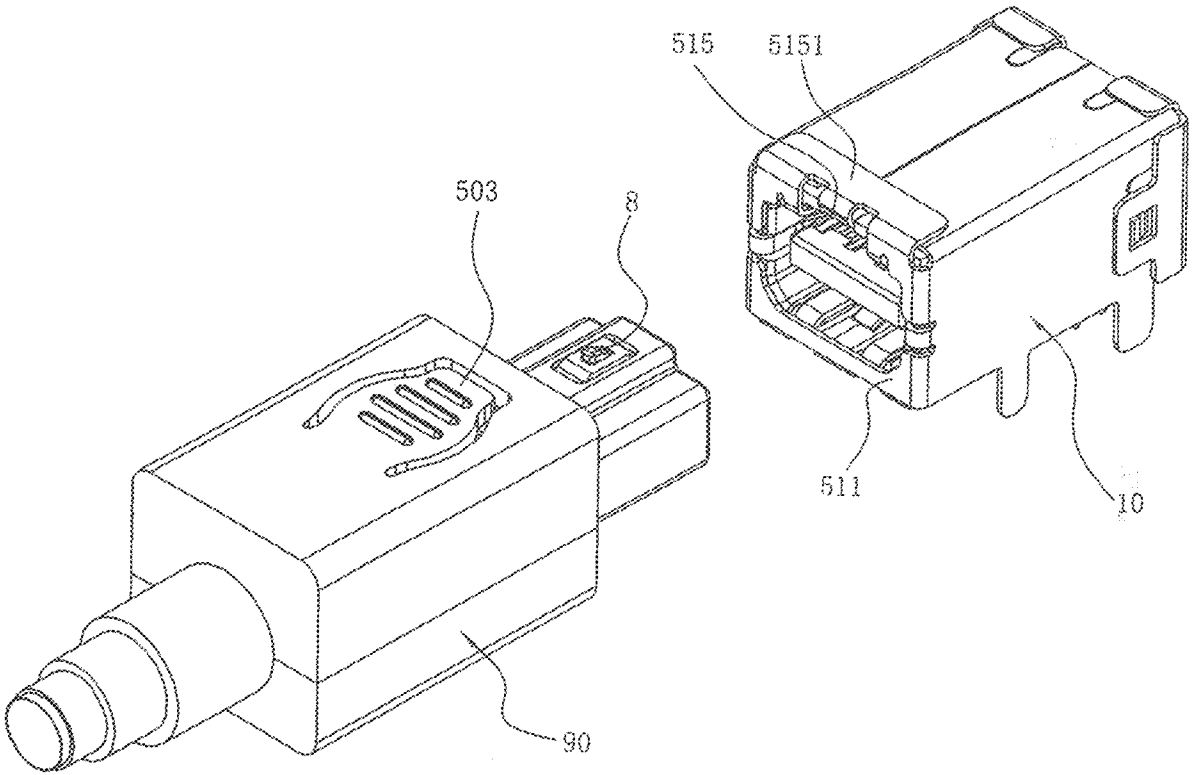
FIG. 1 is a perspective view of an embodiment of a receptacle connector of the present disclosure and an embodiment of a plug connector cable assembly.
Figure 2:
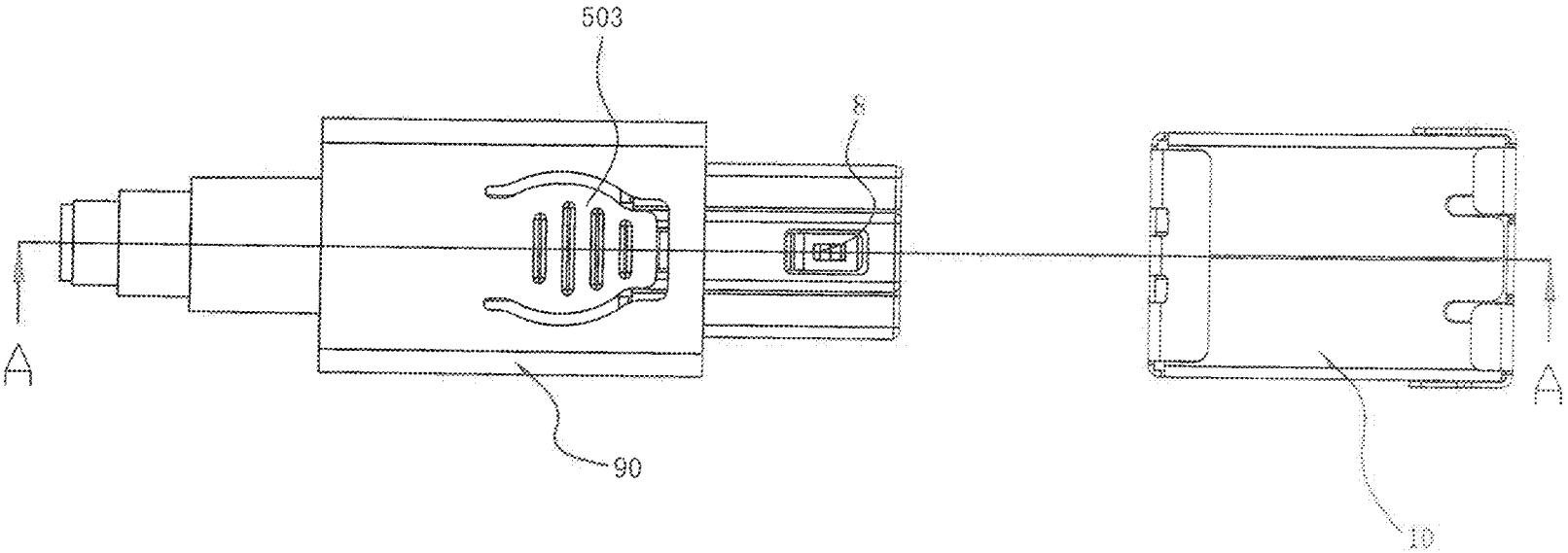
FIG. 2 is a top view that the receptacle connector and the plug connector cable assembly shown in FIG. 1 are separated from each other.
Figure 3:
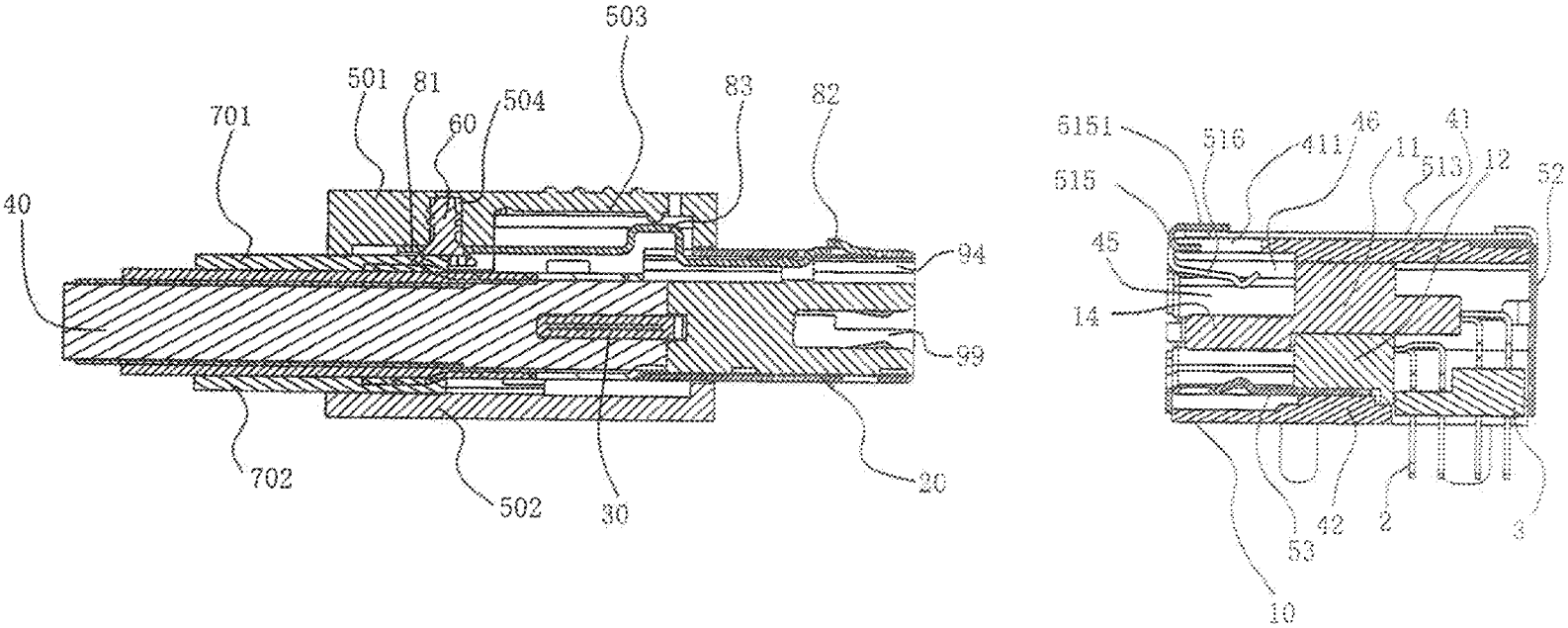
FIG. 3 is a cross-sectional view taken along a line A-A of FIG. 2.
Figure 4:
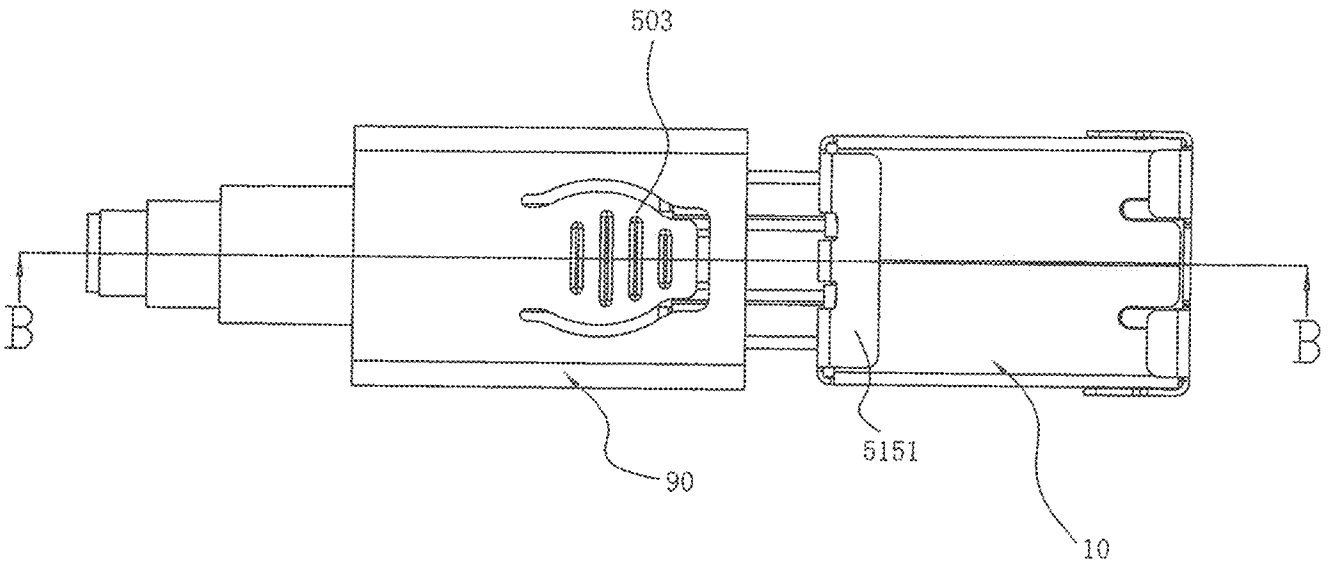
FIG. 4 is a top view that the receptacle connector and the plug connector cable assembly shown in FIG. 1 are mated with each other.
Figure 5:
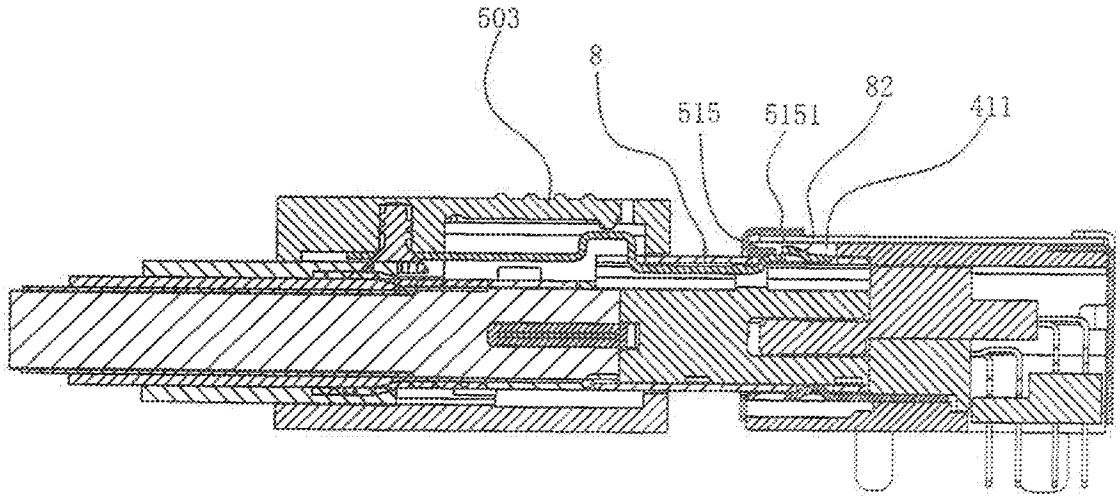
FIG. 5 is a cross-sectional view taken along a line B-B of FIG. 4.
Figure 6:
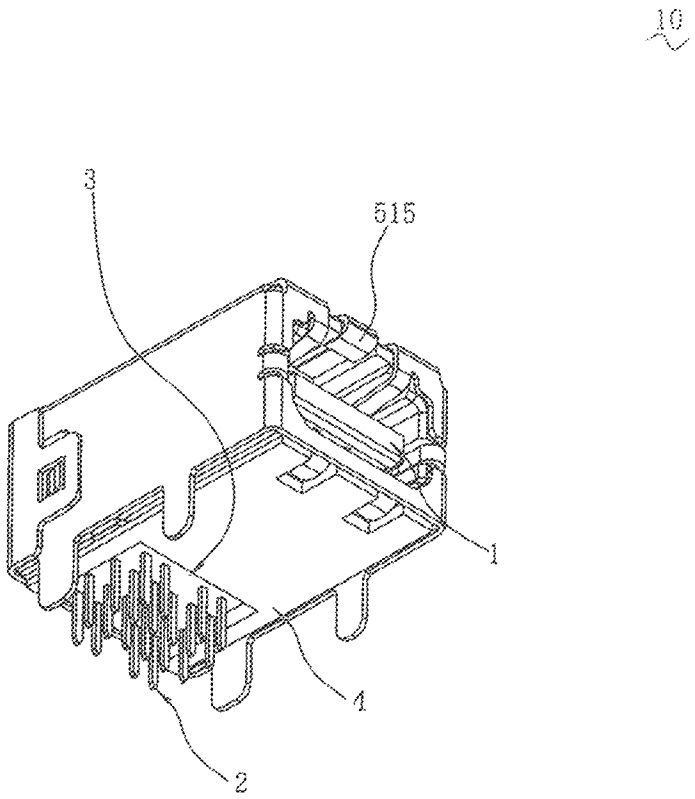
FIG. 6 is a perspective view of the embodiment of the receptacle connector.
Figure 7:
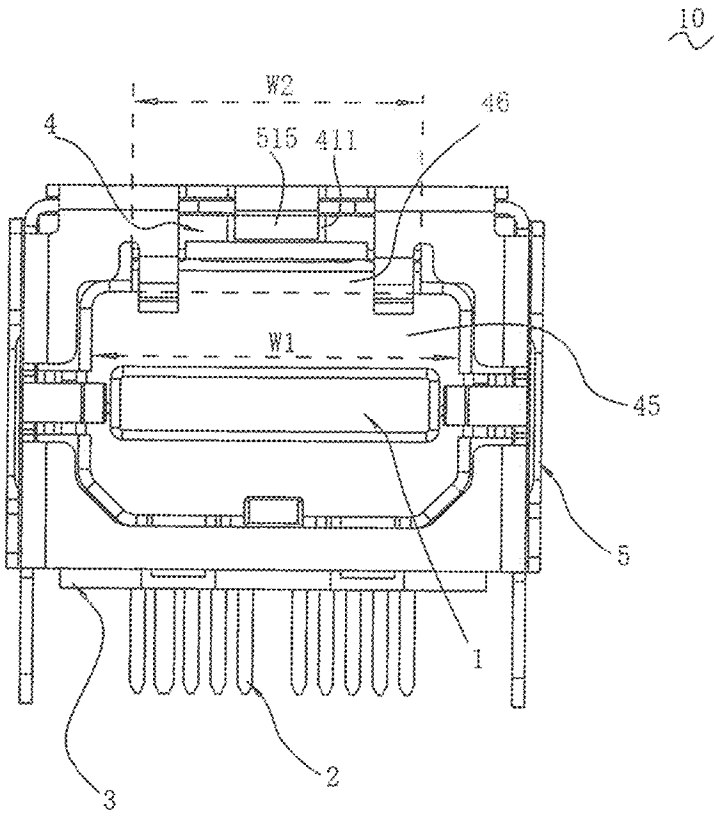
FIG. 7 is a front view of the receptacle connector shown in FIG. 6.
Figure 8:
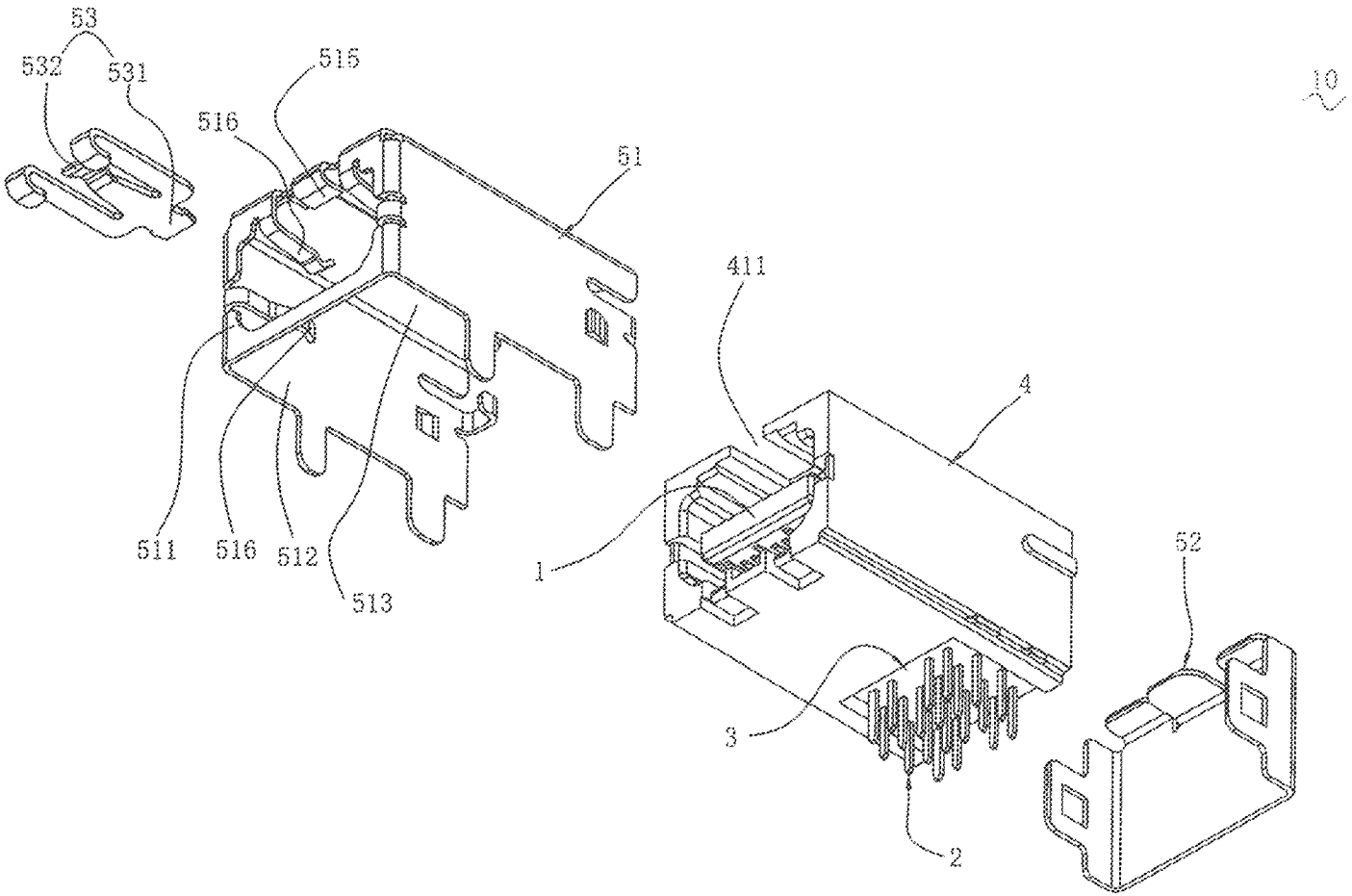
FIG. 8 is an exploded perspective view of the receptacle connector shown in FIG. 6.

Referring to FIGS. 1-5, the present disclosure relates to an receptacle connector 10 in a style of Mini DisplayPort and a correspondingly mating plug connector cable assembly 90 having a hook 8. FIGS. 6-8 relate to an embodiment of an receptacle connector 10 comprises a first housing 1, and a plurality of first terminals 2, a first positioning piece 3 and a first cage 5 which are mounted to the first housing 1.

Figure 9:
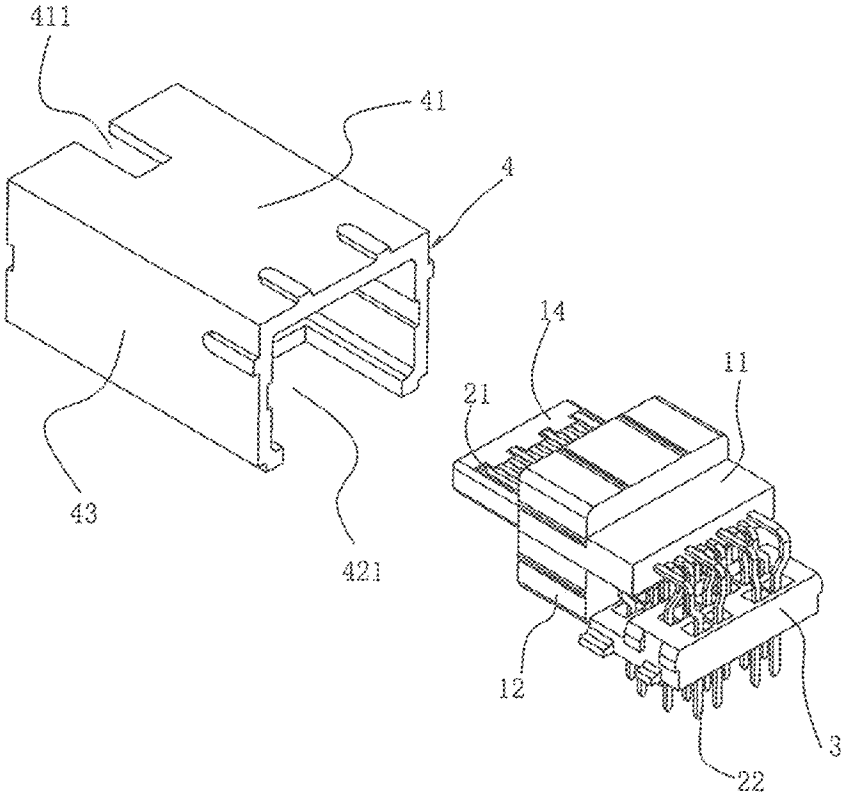
FIG. 9 is an exploded perspective view of receptacle connector shown in FIG. 6 with the first cage removed.

As can be appreciated from FIG. 8 and FIG. 9, the first housing 1 is formed from an insulating material by inject molding, in order to facilitate manufacturing and assembling, specifically, in the embodiment, the first housing 1 comprises a first main body 11 and a second main body 12 stacked up-down together, and a first outer housing 4 installed to outer peripheries of the first main body 11 and the second main body 12. A tongue 14 extends forwardly out from the first main body 11 and an upper side surface and a lower side surface of the tongue 14 are respectively provided with a plurality of terminal grooves 141. It is worth mentioning that, the tongue 14 is formed by extending forwardly out from the first main body 11 in the embodiment, and the tongue 14 may also be formed by extending forwardly out from the first outer housing 4 in other embodiments (not shown in the Figures); in addition, the first main body 11 and the second main body 12 in the embodiment are not necessary, and may also be omitted in some embodiments (not shown in the Figures).

The first outer housing 4 comprises a top wall 41, a bottom wall 42 and two side walls 43 connected between the top wall 41 and the bottom wall 42. The first outer housing 4 is installed to the outer peripheries of the first main body 11 and the second main body 12, a front end of the first outer housing 4 is enclosed to form a first mating cavity 45 provided around the tongue 14 and a receiving cavity 46 positioned above and communicated to the first mating cavity 45, and a width W2 of the receiving cavity 46 is smaller than a width W1 of the first mating cavity 45 (referring to FIG. 7). A front end of the top wall 41 is further penetratingly opened with a receiving groove 411 above the receiving cavity 46, the receiving groove 411 is communicated to the receiving cavity 46. A rear end of the bottom wall 42 is provided with a notch 421.

Figure 10:
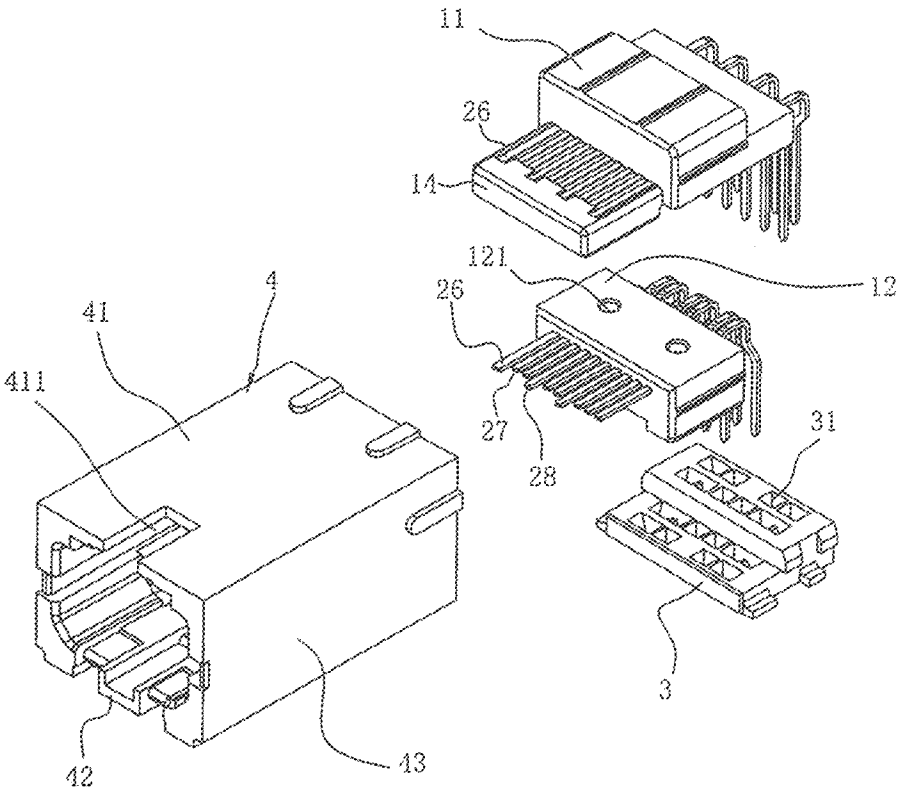
FIG. 10 is an exploded perspective view of a housing, terminals and a positioning piece of the receptacle connector shown in FIG. 6.
Figure 11:
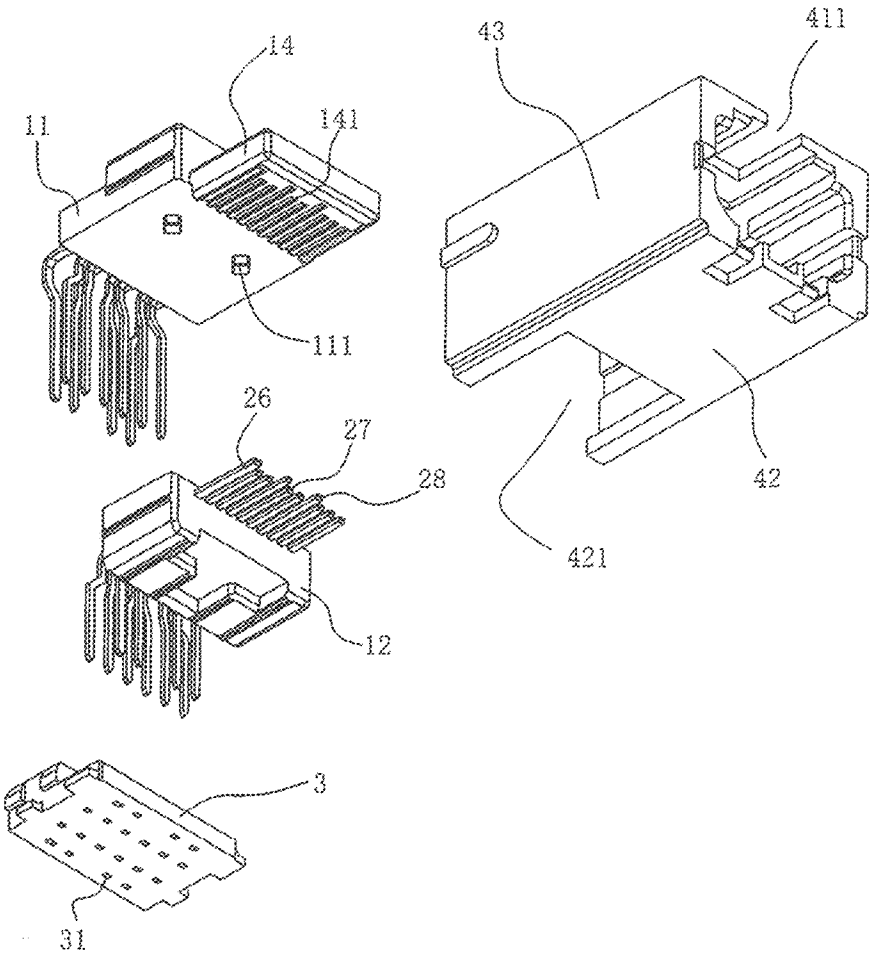
FIG. 11 is another exploded perspective view of the housing, terminals and the positioning piece of the receptacle connector shown in FIG. 6.
Figure 12:
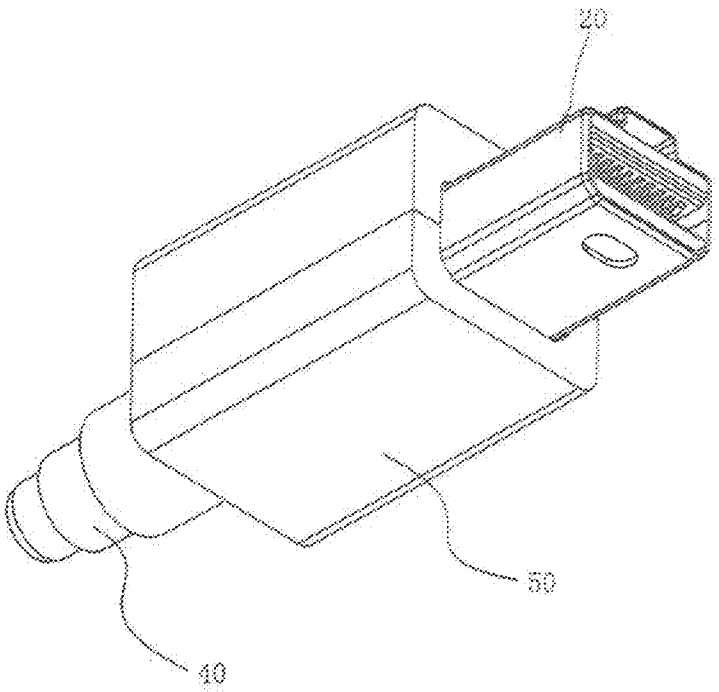
FIG. 12 is a perspective view of the embodiment of the plug connector cable assembly.

Referring to FIG. 10 and FIG. 11, two positioning protruding posts 111 protrudes downwardly from the first main body 11. Two positioning grooves 121 are correspondingly recessed on the second main body 12, these two positioning grooves 121 and the two positioning protruding posts 111 are correspondingly engaged together, so as to relatively position the first main body 11 and the second main body 12.

As can be appreciated, first terminals 2 are formed by stamping and bending a metal material, and are fixed to the first housing 1. Each first terminal 2 has a mating portion 21 and a tail 22 that is configured to be soldered to the supporting circuit board. The mating portions 21 of these first terminals 2 are respectively provided at the upper side and the lower side of the tongue 14. In the embodiment, these first terminals 2 are respectively embedded into the first main body 11 and the second main body 12 by insert molding and are provided respectively at the upper side and the lower side of the tongue 14, and the mating portions 21 of the first terminals 2 embedded into the second main body 12 are correspondingly received in the terminal grooves 141 at the lower side of the tongue 14, this fixation structure facilitates assembling and positioning of the first terminals 2 and prevents the first terminals 2 from deforming. And the two rows of first terminals 2 respectively positioned at the upper side and the lower side of the tongue 14 each comprise a current terminal 26, a plurality of pairs of differential signal terminals 27 which are positioned slightly behind the current terminal 26 and a plurality of ground terminals 28. The mating portions of these two current terminals 26 are provided oppositely up and down respectively at the upper side and the lower side of the tongue 14, and width of the mating portions of these two current terminals 26 are greater than width of the mating portions of these differential signal terminals 27. That the mating portions of such the current terminals 26 have the greater width and the oppositely up and down arrangement structure facilitates power transmission.

Referring to FIG. 9, FIG. 10 and FIG. 11, the first positioning piece 3 is formed from a plastic material by inject molding, and is mounted beside the second main body 12, and is positioned at the notch 421 of the bottom wall 42 of the first outer housing 4. The first positioning piece 3 is provided with a plurality of vias 31 to allow the corresponding tails 22 of these first terminals 2 to pass through, thus a short circuit due to deformation of the tail 22 of the first terminal 2 can be avoided.

Referring to FIG. 8, the first cage 5 is formed by stamping and bending a metal material, is mounted to an outer periphery of the first housing 1, and comprises a body portion 51, a rear cover 52 and a resilient latch piece 53 which are engaged with the body portion 51.

The body portion 51 comprises a front plate 511, two side plates 512 bending rearwardly from both sides of the front plate 511 and extending and a top plate 513 formed by oppositely bending from top sides of the two side plates 512 and extending to be assembled together. A top end of the front plate 511 is firstly bent downwardly and then bent rearwardly and extends to form a locking portion 515 which extends downwardly into the receiving groove 411 of the first outer housing 4. Referring to FIGS. 1-5, specifically, in the embodiment, the top end of the front plate 511 is firstly bent rearwardly to form a fold edge 5151, and then a center of a front edge of the fold edge 5151 is firstly bent downwardly and then bent rearwardly and extends to form the above locking portion 515. As shown in FIG. 5, the locking portion 515 can engage the hook 8 of the mating plug connector 20, so as to lock the receptacle connector 10 and the plug connector 20 together to avoid accidental disengagement. The front plate 511 is further bent towards inside of the first mating cavity 45 respectively from both sides of the locking portion 515 and extends to form two first resilient arms 516, front ends of the two side plates 512 are also respectively bent towards inside of the first mating cavity 45 and extend to form two first resilient arms 516. The rear cover 52 is latched to rear ends of the top plate 513 and the two side plates 512 of the body portion 51, so as to provide shielding for a rear end of the receptacle connector 10.

The resilient latch piece 53 comprises a latching portion 531 extending rearwardly and latching on the first housing 1 and a second resilient arm 532 extending forwardly into the first mating cavity 45 from the latching portion 531. The second resilient arm 532 is cooperative with the first resilient arms 516, which can latch on side surfaces of the plug connector 20, so as to increase the engagement force between the receptacle connector 10 and the plug connector 20.

A manufacturing process of the receptacle connector 10 of the present disclosure generally includes the following steps: firstly molding the first main body 11 and second main body 12 respectively at outer peripheries of these terminals 2; then assembling the first main body 11 and the second main body 12 together and inserting into the first outer housing 4, subsequently mounting the first positioning piece 3 to the first outer housing 4; then rearwardly insert the body portion 51 to the outer periphery of the first outer housing 4 from the front of the first outer housing 4, subsequently mounting the rear cover 52 to a rear end of the body portion 51 from the rear to the front, finally interposing and fixing the resilient latch piece 53 to the first outer housing 4 from the front to the rear.

Referring to FIG. 3, FIG. 5 and FIGS. 12-17, the plug connector cable assembly 90 comprises an plug connector 20, a circuit board 30 provided at the rear of the plug connector 20, and a cable 40 electrically connected to the circuit board 30, a second outer housing 50 surrounding outer periphery, a fastener (a bolt 60 in the embodiment) for fixing the hook 8, a third cage 70 and an insulative inner housing 80. The plug connector 20 comprises a second housing 9, a plurality of second terminals 6 mounted to the second housing 9, a second cage 7 installed to an outer periphery of the second housing 9 and the hook 8 protruding upwardly from the second cage 7 and capable of moving up and down.

The second housing 9 comprises a base portion 91, and an upper mating board 92 and a lower mating board 93 which extend forwardly from the base portion 91. A guide frame 95 protruding at both sides thereof and recessed at a center thereof is provided above the upper mating board 92.

The second terminals 6 are formed by stamping and bending a metal material, and are inserted into and fixed to the second housing 9. The each second terminal 6 has a mating portion 61 and a tail 62 configured to be secured to a supporting circuit board. The mating portions 61 of these second terminals 6 are respectively provided at a lower side surface of the upper mating board 92 and an upper side surface of the lower mating board 93. The tails 62 of these second terminals 6 are correspondingly soldered respectively on an upper side surface and a lower side surface of the circuit board 30. The two rows of second terminals 6 respectively positioned on the lower side surface of the upper mating board 92 and the upper side surface of the lower mating board 93 each also comprise a current terminal 66, a plurality of pairs of differential signal terminals 67 and a plurality of ground terminals 68. The mating portions of these two current terminals 66 are provided oppositely up and down respectively at the lower side surface of the upper mating board 92 and the upper side surface of the lower mating board 93. Width of the mating portions of these two current terminals 66 are greater than width of the mating portions of the differential signal terminals 67. That the mating portions of such the current terminals 66 have the greater width and the oppositely up and down arrangement structure facilitates power transmission.

Figure 13:
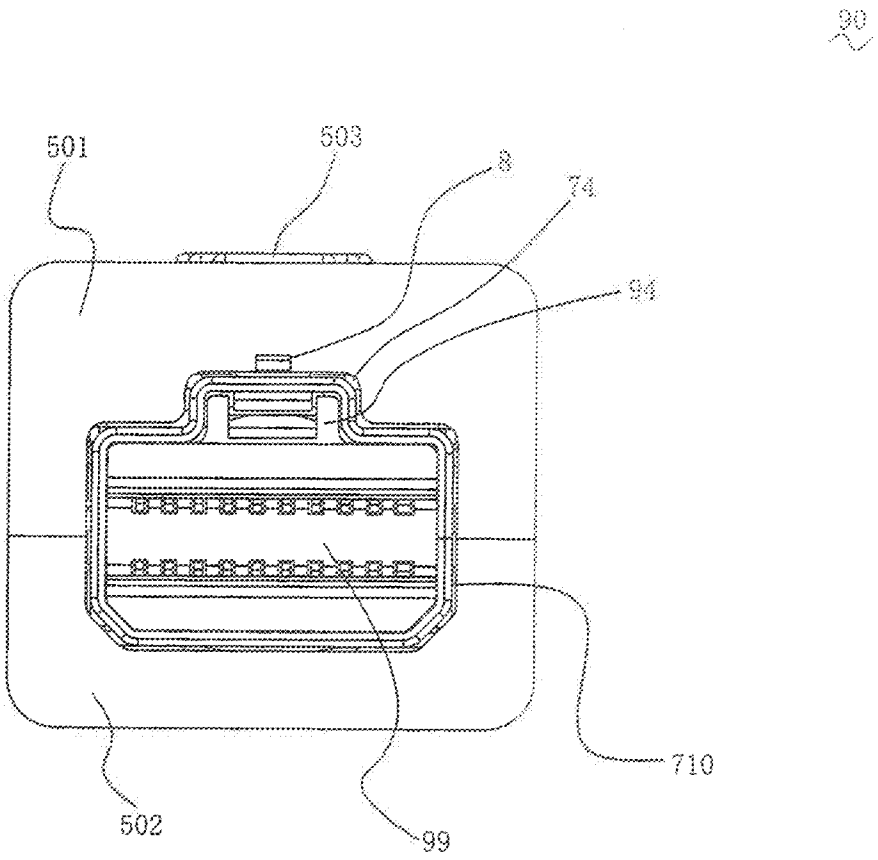
FIG. 13 is a front view of the plug connector cable assembly shown in FIG. 12.
Figure 14:
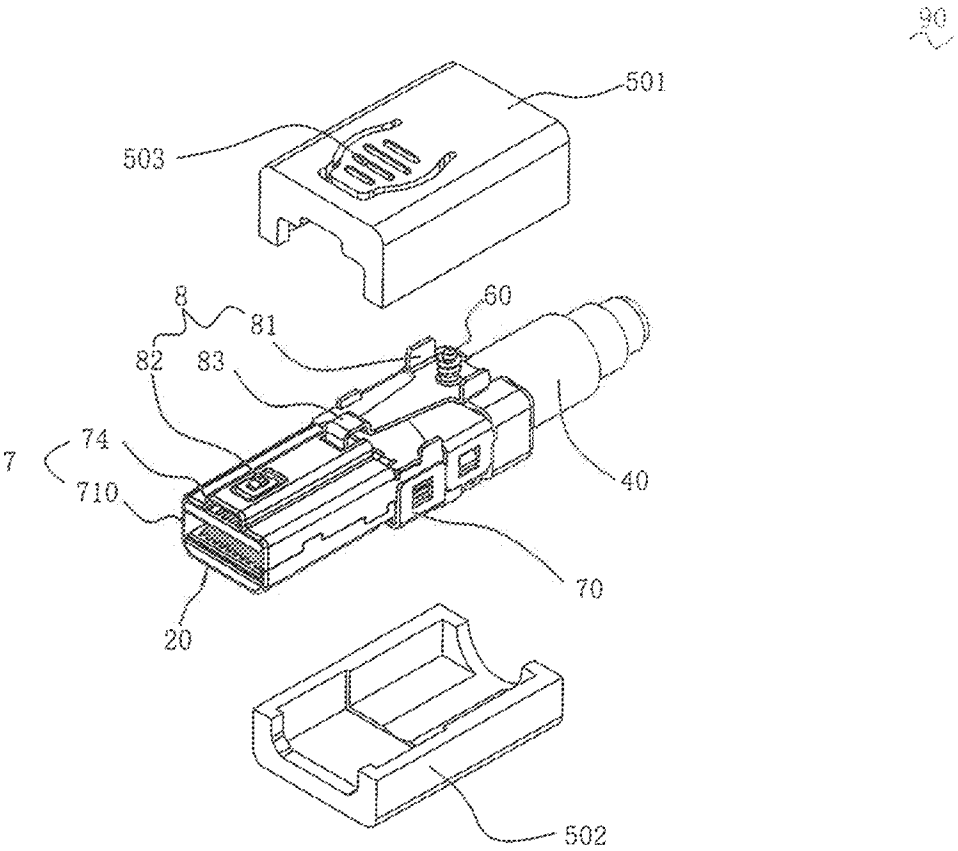
FIG. 14 is an exploded perspective view of the plug connector cable assembly shown in FIG. 12.
Figure 15:
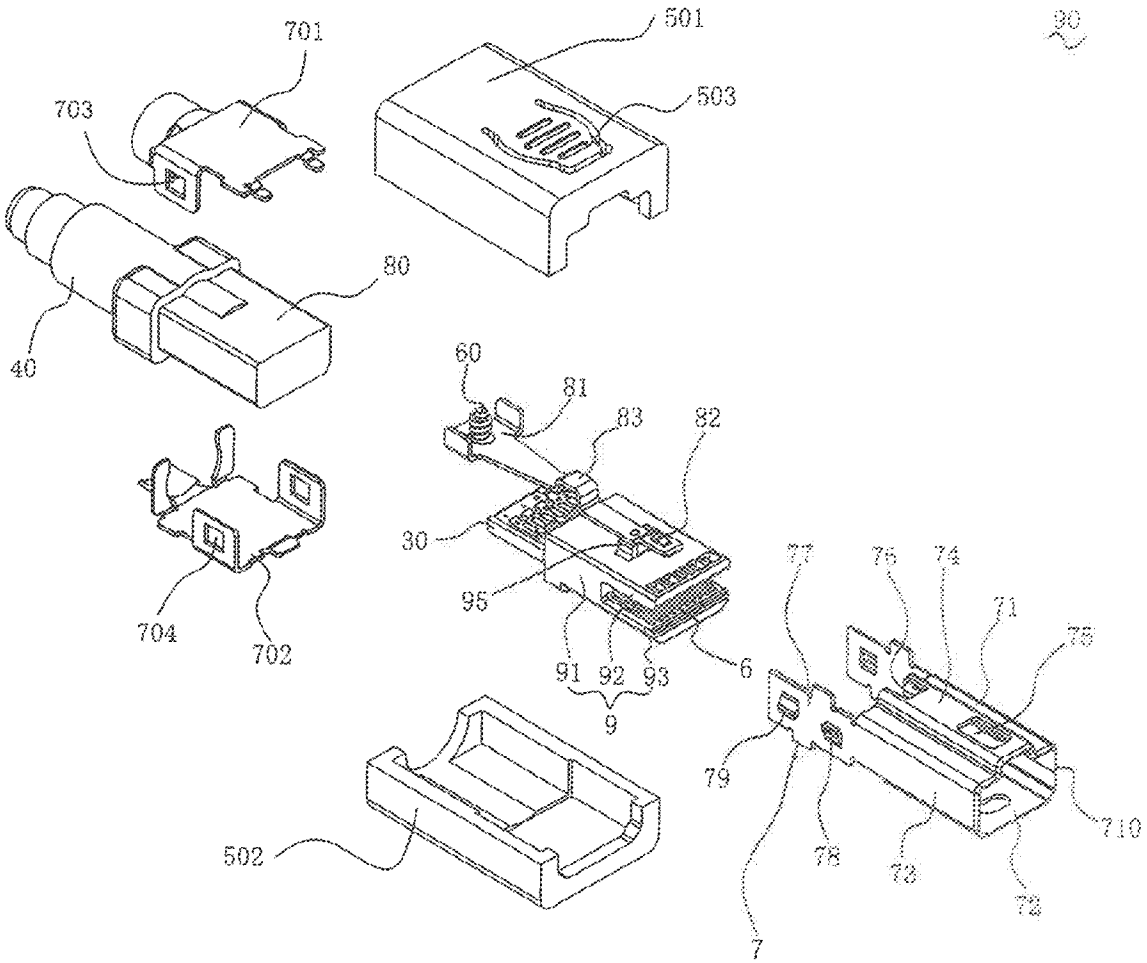
FIG. 15 is a further exploded perspective view of the plug connector cable assembly shown in FIG. 12.
Figure 16:
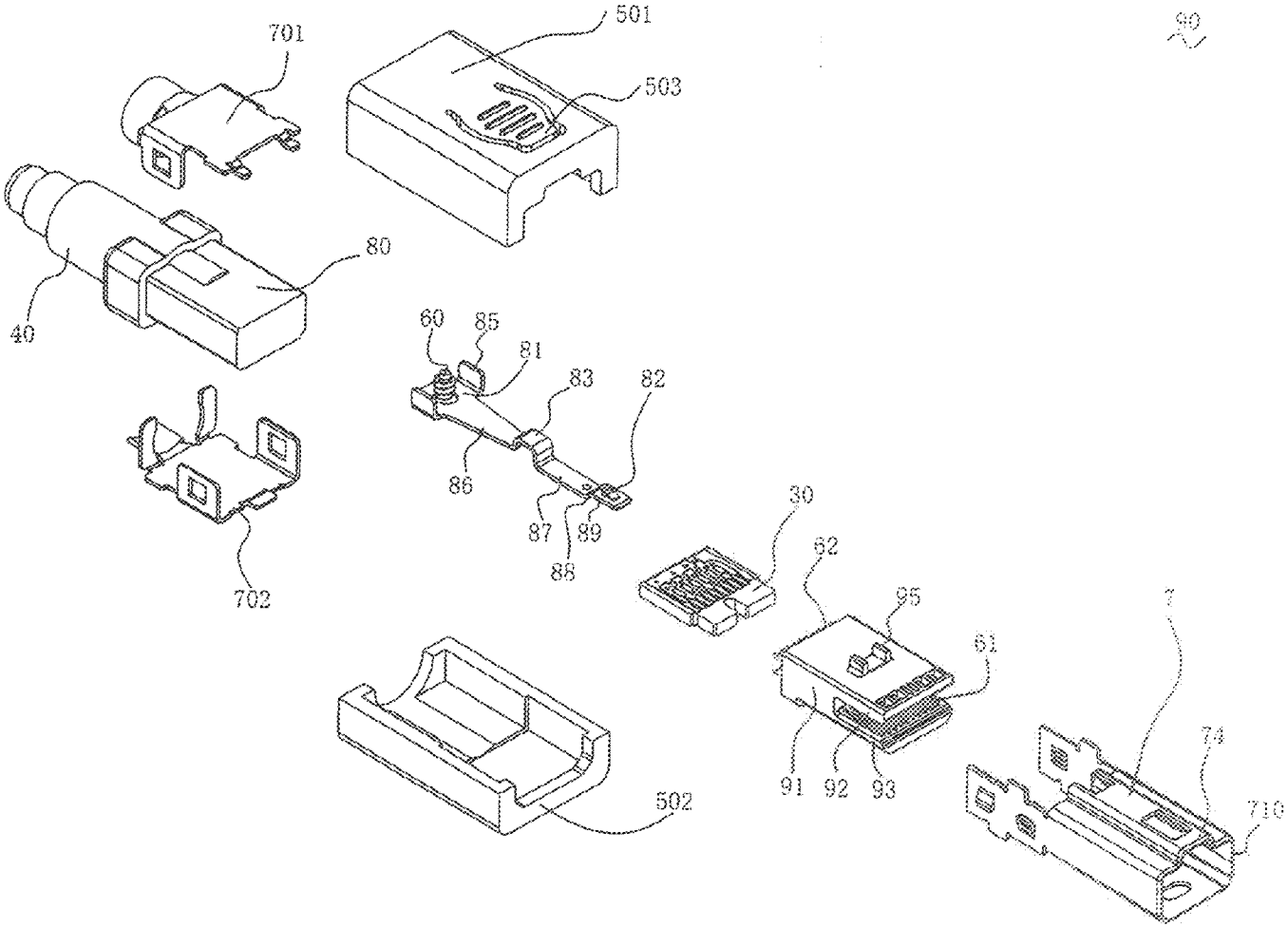
FIG. 16 is an exploded perspective view of the plug connector cable assembly shown in FIG. 12.
Figure 17:
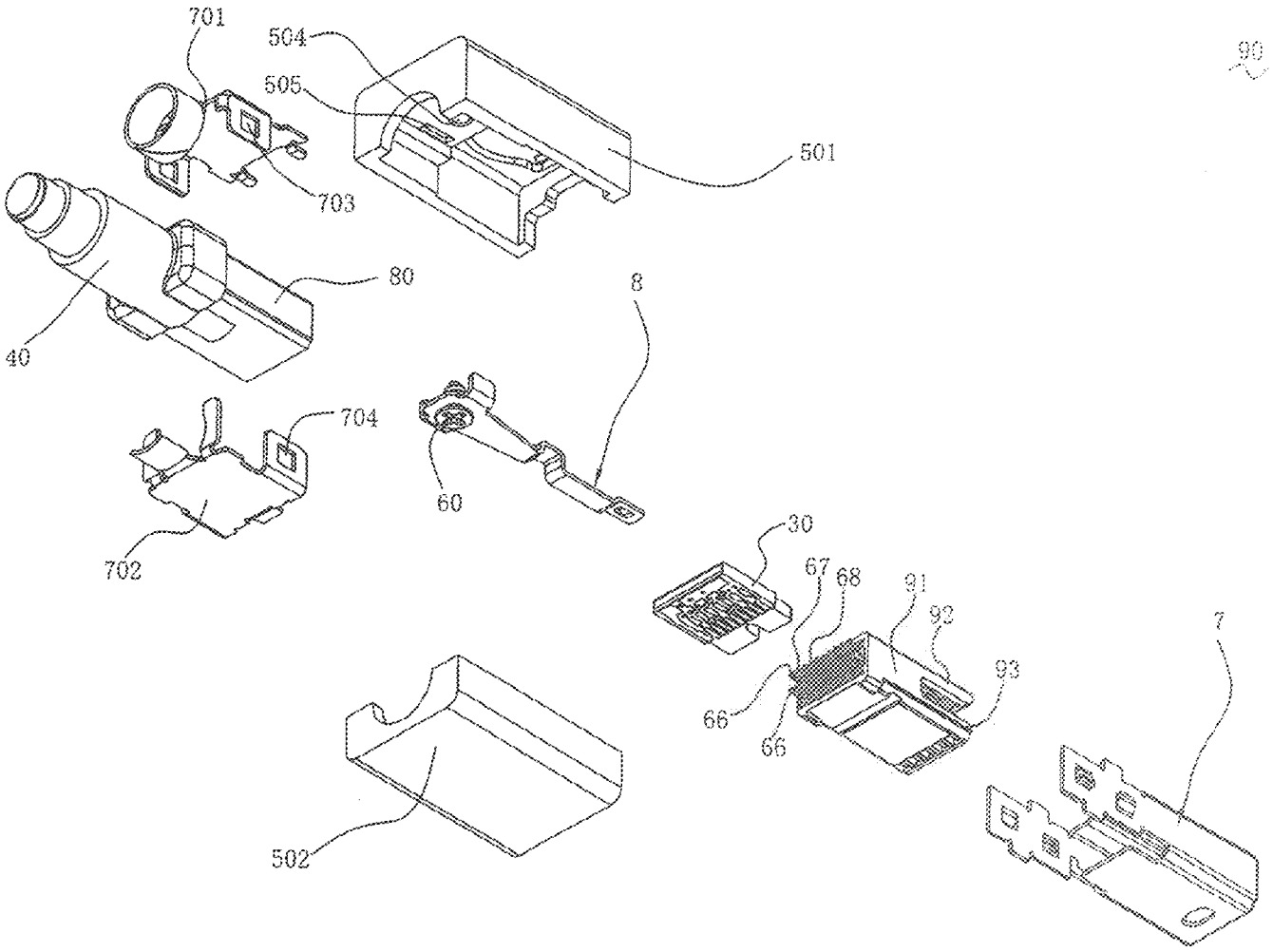
FIG. 17 is another exploded perspective view of the plug connector cable assembly shown in FIG. 12.

Referring to FIGS. 14-17, the second cage 7 is formed by stamping and bending a metal material, the second cage 7 is generally shaped as a convexity which is big at a lower side and small at an upper side, and comprises a main body portion 710 and a protruding portion 74 positioned above the main body portion 710 and having a smaller width. Referring to FIG. 15, the main body portion 710 of the second cage 7 comprises a top plate 71, a bottom plate 72 and two side plates 73 connected between the top plate 71 and the bottom plate 72. A middle part of the top plate 71 protrudes upwardly to form the protruding portion 74. A top surface of the protruding portion 74 is provided with an opening 75 penetrating up and down, a rear end of the top surface of the protruding portion 74 is opened with a groove 76. The second cage 7 further comprises two extending arms 77 extending rearwardly respectively from the two side plates 73, the each extending arm 77 is provided with a first latch 78 and a second latch 79. The main body portion 710 of the second cage 7 and the upper mating board 92 and the lower mating board 93 are cooperative and enclosed to form a second mating cavity 99;

the protruding portion 74 of the second cage 7 and the upper mating board 92 are cooperative and enclosed to form a latching cavity 94 (referring to FIG. 13).

A hook 8 is formed by stamping and bending a metal material, and comprises a fixed portion 81 positioned at a rear end thereof, a first extending portion 86 extending forwardly from the fixed portion 81, a pressing portion 83 protruding upwardly from a front end of the first extending portion 86 and having an inverted U-shaped configuration, a second extending portion 87 extending forwardly from the pressing portion 83, an elevating portion 88 bending upwardly from a front end of the second extending portion 87 and extending, a third extending portion 89 bent forwardly from a top end of the elevating portion 88 and extending, and a hook portion 82 protruding upwardly from a center of the third extending portion 89. The third extending portion 89 is correspondingly received in the opening 75 at the top of the second cage 7. The hook portion 82 can move up and down in the latching cavity 54 and protrudes upwardly out from the protruding portion 74 of the second cage 7 via the opening 75. The fixed portion 81 is provided with a mounting hole penetrating up and down and two opposite latching pieces 85. The pressing portion 83 is correspondingly received in the groove 76 of the second cage 7, and protrudes upwardly above the protruding portion 74 of the second cage 7. A front part of the hook 8 is suspended on the guide frame 95 of the second housing 9, so as to prevent the hook portion 82 from moving to the left and the right.

The circuit board 30 is mounted at the rear end of the plug connector 20, and the circuit board 30 and the tails 62 of these second terminals 6 are correspondingly soldered together. The cable 40 comprises a plurality of wires which are correspondingly soldered to a rear end of the circuit board 30, so as to establish an electrical connection with the corresponding second terminals 6 via the circuit board 30.

The insulative inner housing 80 is formed to an outer periphery of the circuit board 30 from a plastic material by overmolding, so as to protect electrical connection parts of the circuit board 30 with the plug connector 20 and the cable 40. It should be noted that, in FIG. 15 and FIG. 16, a shape of the insulative inner housing 80 is illustrative, an engagement structure of the insulative inner housing 80 and the circuit board 30 is not completely present.

As shown in FIG. 15, the third cage 70 is formed by stamping and bending a metal material, and is mounted to an outer periphery of the insulative inner housing 80. The third cage 70 comprises an upper shell 701 and a lower shell 702. The upper shell 701 is provided with two latching openings 703 to correspondingly latch two second latches 79 of the extending arm 77 of the second cage 7. The lower shell 702 is provided with two latching openings 704 to correspondingly latch two first latches 78 of the extending arm 77 of the second cage 7.

The second outer housing 50 comprises an upper housing 501 and a lower housing 502 engaged with each other. The upper housing 501 is provided with a button 503 which is provided above the pressing portion 83 of the hook 8, thus pressing can be performed on the hook 8. A lower side surface of the upper housing 501 is also provided with a threaded hole 504 and two latching openings 505 which correspond to the fixed portion 81 of the hook 8, the two latching pieces 85 of the fixed portion 81 can be correspondingly inserted into the two latching openings 505. The bolt 60 can be provided through the mounting hole at the fixed portion 81 of the hook 8 and screwed into the threaded hole 504 of the upper housing 501, so as to securely fix the hook 8 to the second outer housing 50. In other embodiments, other fasteners such as screws can also be used to replace the bolt 60.

An assembling process of the plug connector cable assembly 90 of the present disclosure generally includes the following steps: firstly inserting these second terminals 6 into the second housing 9, then installing the second cage 7 to the outer periphery of the second housing 9 from the front to the rear to complete assembling of the plug connector 20; subsequently soldering these second terminals 6 to the front end of the circuit board 30, then soldering the cable 40 to the rear end of the circuit board 30; next forming the insulative inner housing 80 at the outer periphery of the circuit board 30 by overmolding to protect soldering parts; then mounting the third cage 70 to rear end of the second cage 7; subsequently inserting the hook 8 into the protruding portion 74 of the second cage 7 from the rear to the front, until the third extending portion 89 is positioned in the opening 75 of the second cage 7; then allowing the upper housing 501 of the second outer housing 50 to cover above the hook 8, and allowing the both to engage together via the bolt 60; finally mounting the lower housing 502 and the upper housing 501 of the second outer housing 50 together.

Rear to referring to FIGS. 1-5, when the receptacle connector 10 and the plug connector 20 of the plug connector cable assembly 90 of the present disclosure are mated, the protruding portion 74 of the plug connector 20 can be correspondingly received in the receiving cavity 46 of the receptacle connector 10, the hook portion 82 of the hook 8 of the plug connector 20 can engage the locking portion 515 of the receptacle connector 10, so as to increase the engagement force of the two electrical connectors 10, 20 to avoid accidental disengagement. When the two electrical connectors 10, 20 which are connected together are required to disengage, only pressing down the button 503 is required, the button 503 presses the pressing portion 83 of the hook 8 to drive the hook portion 82 to move downwardly to reach a position where the hook portion 82 disengages from the locking portion 515, then pulling action is performed, the separation of the electrical connectors 10, 20 can be easily achieved.

Compared with the prior art, the receptacle connector 10 and the plug connector 20 of the present disclosure have the following beneficial effects: by that the first cage 5 of the receptacle connector 10 is additionally provided with the receiving cavity 46 and the hook portion 515 positioned above the receiving cavity 46, and the plug connector 20 is correspondingly provided with the protruding portion 74 and the hook 8 protruding upwardly from the protruding portion 74, the receptacle connector 10 and the plug connector 20 of the present disclosure are correspondingly latched and locked together, thereby having a strong engagement force to prevent the two electrical connectors 10, 20 from being accidentally disengaged.

The above described is only the embodiments of the present disclosure, and is not intended to limit the implementation solution of the present disclosure, those skilled in the art may very conveniently make the appropriate variations or modifications according to the main concept and spirit of the present disclosure, so the protective scope should be defined by the protective scope of the claims.

What is claimed is:

1. An receptacle connector, which can mate with an plug connector having a hook, comprising:

a housing with a front end and a tongue extends forwardly from the housing, wherein a first mating cavity is provided around the tongue and a receiving cavity is positioned above and communication to the first mating cavity, wherein a width of the receiving cavity is smaller than a width of the first mating cavity; the first housing being further penetratingly opened with a receiving groove above the receiving cavity;

a plurality of terminals, each of the plurality of terminals having a mating portion and a tail, the mating portions of the plurality of terminals being respectively provided at an upper side and a lower side of the tongue, the plurality of terminals comprising two current terminals and a plurality of differential signal terminals, the mating portion of one of the two current terminals being provided on the upper side and the mating portion of the other of the two current terminals being provided on the lower side of the tongue, wherein width of the mating portions of the two current terminals is greater than width of the mating portions of the differential signal terminals; and a first cage which is mounted to an outer periphery of the housing, the first cage being provided with a locking portion for engaging, in operation, a hook of an plug connector, the locking portion protruding downwardly into the receiving groove of the first housing.

2. The receptacle connector according to claim 1, wherein the first cage comprises a front plate provided at a front end of the receptacle connector, a top end of the front plate is bent rearwardly to form a fold edge and then a center of a front edge of the fold edge is firstly bent downwardly and then bent rearwardly and extends to form the locking portion.

3. The receptacle connector according to claim 1, wherein the first cage comprises a front plate provided at a front end of the receptacle connector and a leaf spring latch piece, the front plate extends toward inside of the first mating cavity to form a plurality of first resilient arms, the leaf spring latch piece comprises a latching portion latching on the first housing and a second resilient arm extending into the first mating cavity.

4. The receptacle connector according to claim 1, wherein the first housing comprises a first main body and a second main body stacked up-down together, and a first outer housing installed to outer peripheries of the first main body and the second main body, these first terminals are embedded into the first main body and the second main body respectively.

5. The receptacle connector according to claim 4, wherein the tongue extends forwardly out from the first main body, the upper side and the lower side of the tongue are provided with a plurality of terminal grooves, the mating portion of the first terminal embedded into the second main body are correspondingly received in the terminal grooves at the lower side of the tongue; the first mating cavity and the receiving cavity are recessed at a front end of the first outer housing, the receiving groove is opened at a top of the first outer housing.

* * * * *